US005615508A

United States Patent [19]

Miller et al.

[11] Patent Number: 5,615,508

[45] Date of Patent: Apr. 1, 1997

[54] CAMOUFLAGE GUNSTOCK

[75] Inventors: Forrest A. Miller, Seattle; Robert A. Wheeler, Vashon, both of Wash.

[73] Assignee: Pacific Research Laboratories, Inc., Vashon, Wash.

[21] Appl. No.: 367,045

[22] Filed: Dec. 30, 1994

[51] Int. Cl.[6] ..... F41C 23/00

[52] U.S. Cl. ..... 42/71.01; 428/542.2; 428/919

[58] Field of Search ..... 42/71.01; 428/542.2, 428/542.4, 542.6, 913.3, 919

[56] References Cited

U.S. PATENT DOCUMENTS

| | | | |
|---|---|---|---|
| 2,276,567 | 3/1942 | Donaldson | 428/542.2 |
| 3,479,666 | 11/1969 | Webb | 428/919 |
| 3,585,094 | 6/1971 | Ruggles | 428/542.2 |
| 3,660,196 | 5/1972 | Keeling et al. | 156/235 |
| 3,935,049 | 1/1976 | Schmidt et al. | 156/216 |
| 4,560,523 | 12/1985 | Plumley et al. | 264/102 |
| 4,637,954 | 1/1987 | Ohsumi | 428/542.2 |
| 4,676,041 | 6/1987 | Ford | 52/309.11 |
| 4,698,258 | 10/1987 | Harkins | 428/285 |
| 4,762,740 | 8/1988 | Johnson et al. | 428/68 |
| 4,788,759 | 12/1988 | Yano et al. | 29/611 |
| 4,837,056 | 6/1989 | Easley | 428/919 |
| 4,891,176 | 1/1990 | Drysdale et al. | 264/250 |
| 4,934,084 | 6/1990 | Thomas | 42/71.01 |
| 5,035,602 | 7/1991 | Johnson | 425/468 |
| 5,041,260 | 8/1991 | Johnson et al. | 264/510 |
| 5,045,251 | 9/1991 | Johnson | 264/40.1 |
| 5,061,418 | 10/1991 | Ware | 264/46.6 |
| 5,232,650 | 8/1993 | Behan et al. | 264/219 |
| 5,233,743 | 8/1993 | Robertson et al. | 29/527.1 |
| 5,240,661 | 8/1993 | Parker et al. | 264/103 |
| 5,316,709 | 5/1994 | Ko et al. | 264/51 |

FOREIGN PATENT DOCUMENTS

| | | | |
|---|---|---|---|
| 2017087 | 10/1971 | Germany | 42/71.01 |
| 2042465 | 3/1972 | Germany | 42/71.01 |

*Primary Examiner*—Michael J. Carone

*Attorney, Agent, or Firm*—Christensen O'Connor Johnson & Kindness PLLC

[57] ABSTRACT

A gunstock that is provided that includes a core, a unidirectional fiberglass layer, a decorative layer, a woven fiberglass layer, and a resin impregnating the layers. The core includes a forearm, a grip, and a buttstock. The unidirectional fiberglass layer is laid over the core. The decorative layer may be a fabric or a natural foliage that is laid over the unidirectional fiberglass. The woven fiberglass is a seamless sock that is woven directly over the decorative layer. Resin transfer molding is employed to impregnate the resin into the fiber. Once impregnated with the resin and cured, the fiberglass becomes transparent along with the resin such that the decorative layer can be seen through the fiberglass and resin composite. Composite crossbolts are also provided through the action area of the core. These crossbolts include fiberglass arms that extend along the sides of the core toward the butt of the stock. A method for constructing a gunstock as described above is also provided.

35 Claims, 6 Drawing Sheets

CAMOUFLAGE GUNSTOCK

FIELD OF THE INVENTION

This invention relates generally to decorated articles and methods for constructing decorated articles, and more particularly, to camouflage composite gunstocks and methods of constructing them.

BACKGROUND OF THE INVENTION

A camouflage rifle or shotgun stock can prove useful in the field. However, if the camouflage layer is subject to being marred, scratched, torn, or otherwise damaged the usefulness of the gun can be impaired and the aesthetics can be adversely affected.

These camouflage gunstocks have been created in various manners. In one method an injection-molded plastic gunstock is dipped in a liquid that includes a layer of ink floating on the top surface of the liquid. In this ink-transfer method the ink surrounds and clings to the stock. The ink dries once the stock is removed from the liquid. However, since the ink is on the exterior surface of the stock, the camouflage coating can be scratched or otherwise quite easily marred.

Another method of creating a decorated article, such as a camouflaged gunstock, is by applying a layer of fabric to the outside of the stock. However, once again, since the decorative layer is on the outside of the article, it can be easily torn or otherwise damaged in sometimes harsh hunting environments.

Gunstocks are used as an example. However, the same concerns are involved with other articles that include decorative layers. For example, a camouflaged helmet is disclosed in U.S. Pat. No. 3,479,666 (Webb). The camouflage layer on the Webb helmet is impregnated with a resin. However, the camouflage layer is still the most exterior layer on the helmet. Damage to the layer is thus likely.

The methods and decorated articles above do not adequately provide a protected decorative layer on gunstocks and other articles. Accordingly, the present invention was developed that combines a composite article with a well protected decorative layer. The resulting article, e.g., gunstock, is both aesthetically pleasing and durable. The decorative layer is well protected and effective.

SUMMARY OF THE INVENTION

In the present invention a gunstock that is provided that includes a core, a unidirectional fiberglass layer, a decorative layer, a woven fiberglass layer, and a resin impregnating the layers. The core includes a forearm, a grip, and a buttstock. The unidirectional fiberglass layer is laid over the core. The decorative layer is preferably a fabric or natural foliage that is laid over the unidirectional fiberglass. The woven fiberglass is a seamless sock that is woven directly over the decorative layer. Resin transfer molding is employed to impregnate the resin into the fiber. Once impregnated with the resin and cured, the fiberglass becomes transparent along with the resin such that the decorative layer can be seen through the fiberglass and resin composite. Composite crossbolts are also provided through the action area of the core. These crossbolts include fiberglass arms that extend along the sides of the core toward the butt of the stock.

The invention also covers a basic apparatus that includes a core, a decorative layer disposed over the core, and a resin impregnated fiber material. The fiber material is disposed over the decorative layer with the resin impregnated fiber material being substantially transparent such that the decorative layer is seen therethrough. The decorative layer is thus protected from being scratched, marred or otherwise impaired by both the resin and the fiber material. The fiber material is preferably a woven sock of fiberglass seamlessly encasing the core and the decorative layer. The decorative layer may be either a material, natural foliage, or any other decorative substance. A second layer of fiber material is also preferably disposed between the decorative layer and the core.

In an alternate embodiment of the invention, the decorative layer is disposed over the woven fiberglass layer. In this embodiment, the resin permeates the fiberglass layer and the decorative layer. The resin also forms a transparent protective layer over the decorative layer.

As mentioned above regarding the preferred embodiment of the gunstock invention, a first composite crossbolt extends transversely through a portion of the forearm of the core. The first composite crossbolt includes arms extending toward the butt of the gunstock beneath the first fiberglass layer. Alternatively, the arms of the crossbolt may extend above the first fiberglass layer. However, in each case, it is preferred that the resin permeates both the arms of the crossbolt and the fiberglass layers to join one to another for a unified integral shell. A second composite crossbolt is also preferably provided. The second composite crossbolt extends transversely through a portion of the forearm of the core rearwardly of the first composite crossbolt. The second composite crossbolt also includes arms extending toward the butt of the gunstock beneath the first fiber layer. As with the first composite crossbolt, these arms may also extend above the first fiber layer and are preferably intermeshed with the fiberglass layers, as well as, the arms of the first composite crossbolt.

The core of the gunstock is preferably a one-piece rigid foam material. Not only are crossbolts supplied within the core but screw anchor pillars are also disposed within the core. The pillars comprise a fiber material impregnated and encapsulated in resin.

A method of constructing a gunstock is also provided. The method includes forming a core including a forearm, a grip, and a buttstock; placing a decorative material over at least a portion of the core; placing a fiber material over at least a portion of the core; and impregnating the decorative material and fiber material with the resin. The resin forms a layer over both the decorative material and the fiber material.

The method also preferably includes placing a first fiber crossbolt, including crossbolt arms, transversely through a portion of the forearm of the core after forming the core. The crossbolt arms are also placed along the sides of the core. Both the decorative material and the fiber material are preferably impregnated with resin through a resin transfer molding process. The fiber material is preferably placed on the core by weaving it directly onto the core and over the decorative material, such that a seamless shell is created over a substantial portion of the core.

In the preferred embodiment of the method of the invention, a second fiber crossbolt, having arms, is placed through a portion of the forearm of the core before weaving the fiber material onto the core. The preferred method of the invention also includes placing a unidirectional fiberglass material on the core before placing the decorative material and the woven fiberglass over the core.

In an alternate form of the method of the present invention, the decorative material is placed on the core alter the first fiber material is placed on the core. The resin permeates through the decorative material and forms a layer of resin over the decorative material.

A method of decorating an article is also provided that includes the steps of forming a core; placing a decorative layer over at least a portion of the core; placing a first fiberglass layer over the decorative layer; and impregnating the first fiberglass layer with the resin. Through the process, the first fiberglass layer becomes substantially transparent such that the decoration of the article is carded out with the decoration being visible through the resin and the first fiberglass layer.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENT

Figure 1:
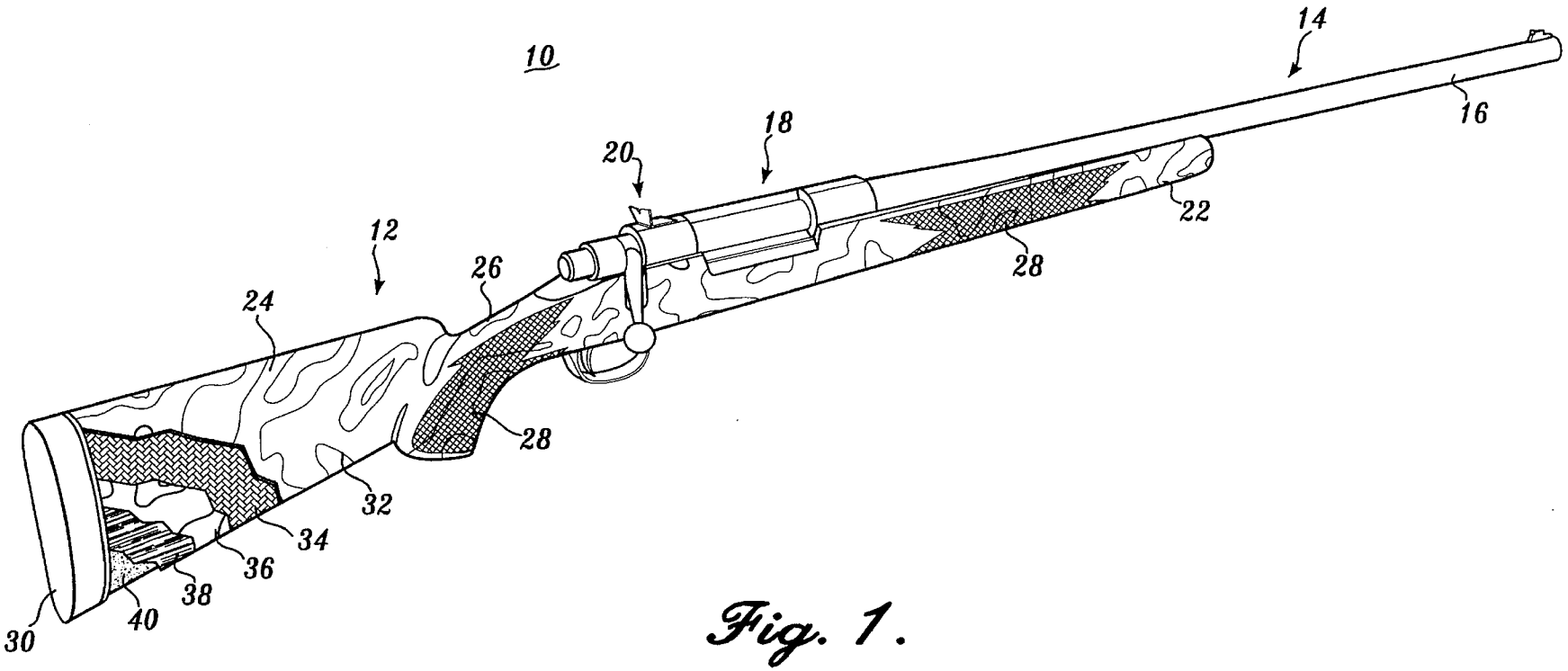
FIG. 1 is a perspective view of a gun of the present invention showing the various layers making up the stock of one preferred embodiment.

FIG. 1 illustrates a preferred embodiment of a gun 10 of the present invention. Like any standard rifle, the gun 10 includes a stock 12 with hardware 14 mounted thereto. Hardware 14 includes a barrel 16, a bolt 18 at the rearward end of the barrel 16, and an action 20. Stock 12 includes a forearm 22, a buttstock 24, and a grip 26. Both forearm 22 and grip 26 include checkering 28 in locations where the gun is to be grasped. A recoil pad 30 is affixed to the rearward end of the buttstock 24.

Stock 12 is constructed of numerous layers. The outermost layer is made up of an epoxy resin 32. This resin 32 is transparent so as to reveal the decorative layer beneath, as described below. The resin 32 permeates through a braided fiberglass 34. As explained below, braided fiberglass 34 is preferably a braid woven directly onto stock 12 to form a sock around stock 12. Once resin 32 permeates fiberglass 34, fiberglass 34 also becomes transparent.

A camouflage layer 36 is disposed beneath fiberglass 34 and can be seen through the transparent fiberglass 34 and resin 32. Camouflage layer 36 may be made of a fabric material or any other decorative material placed beneath fiberglass 34. Camouflage layer 36 is thus protected from being marred or scraped off the surface of stock 12 since it is not only beneath resin 32 but also beneath braided fiberglass 34. It would be virtually impossible to mar the surface of camouflage layer 36 without breaking stock 12 since braided fiberglass 34 is the main structural component of stock 12.

Preferably, a unidirectional fiberglass layer 38 is disposed beneath camouflage layer 36. Unidirectional fiberglass 38 extends along the entire length of stock 12 and, is itself, permeated with a resin. The resin may be the same resin 32 that permeates braided fiberglass 34 or it may be separate epoxy resin laid up on unidirectional fiberglass 38 before camouflage layer 36 is placed thereon.

Finally, a foam core 40 is disposed beneath unidirectional fiberglass 38. Foam core 40 is made up of a rigid plastic foam which is sound absorbing and provides a basic shape and lightweight center for stock 12. The other layers are wrapped around foam core 40 with resin 32 preferably injection molded around the layers.

Figure 2:
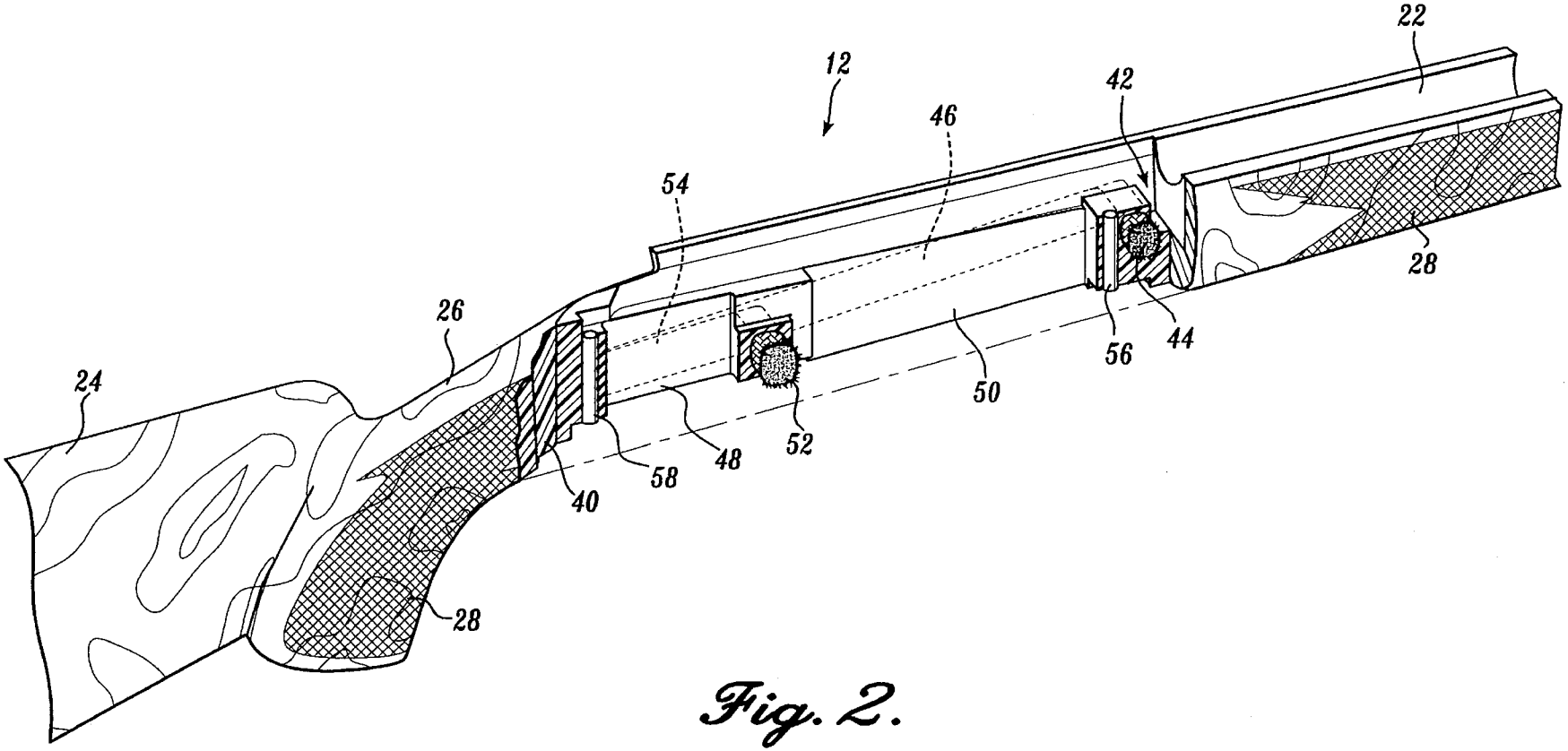
FIG. 2 is a perspective view of the stock with a cut-away portion in the action area.
Figure 3:
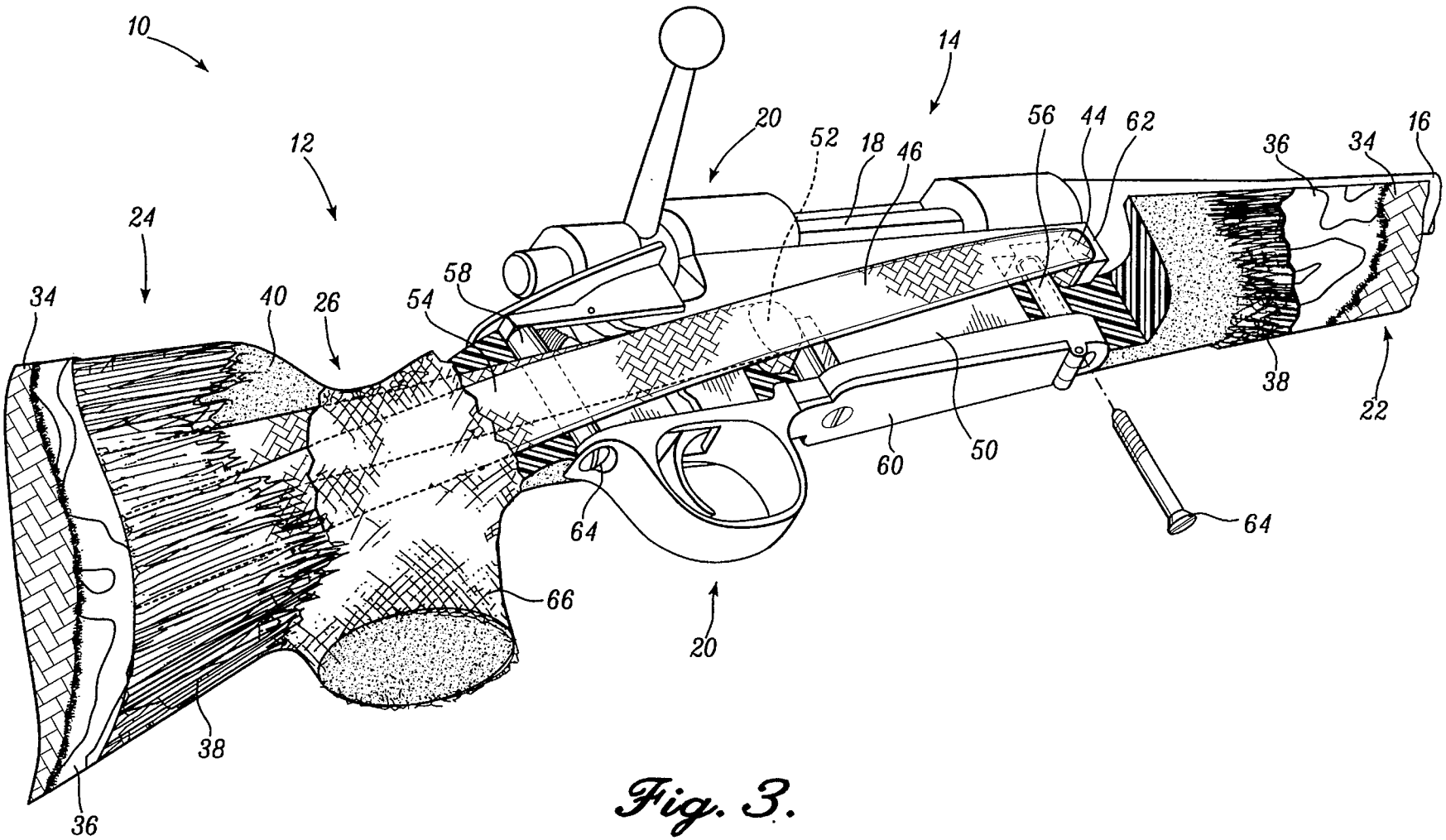
FIG. 3 is a perspective view of a portion of the gun showing the interface between the hardware and the stock.

Referring now to FIGS. 2 and 3, some of the internal construction details of stock 12 will now be discussed. Stock 12 of the present invention includes a lug recess 42 within forearm 22 of stock 12 for receiving a recoil lug 62 (illustrated in FIG. 3). A recoil crossbolt 44 is provided directly behind lug recess 42. Recoil crossbolt 44 transfers the shock from recoil lug 62 to buttstock 24. Recoil crossbolt 44 is constructed of woven fiberglass material that is permeated with resin 32 or other resin to form a strong structural member. Recoil crossbolt 44 extends through core 40 behind lug recess 42 and then continues to extend in a U-shaped fashion with recoil crossbolt arms 46 in a rearward direction from crossbolt 44. Recoil crossbolt arms 46 are an integral part of recoil crossbolt 44 and simply fan out and mesh with unidirectional fiberglass 38 such that both portions of fiberglass become essentially one structural element. Recoil crossbolt arms 46 extend rearwardly along buttstock 24. Thus, the recoil crossbolts 44 become a continuous part of the outer shell of stock 12.

Note that an action recess 48 is provided to house action 20. Also, a magazine recess 50 is provided behind recoil crossbolt 44. An action crossbolt 52 is provided between action recess 48 and magazine recess 50. Action crossbolt 52 is similar to recoil crossbolt 44. Action crossbolt 52 is also continuous with the outer shell. The crossbolt portion itself is solid fiberglass permeated with resin 32 in the action area. The fiberglass from action crossbolt 52 actually flows continuously from the ends of action crossbolt 52 into action crossbolt arms 54 to mesh with recoil crossbolt arms 46 and the rest of the continuos outer shell of stock 12.

Also illustrated in FIGS. 2 and 3 are forward and rearward pillars 56 and 58 respectively. Forward pillar 56 is located directly behind recoil crossbolt 44. Forward pillar 56 is oriented vertically and is cylindrical in shape to receive a screw 64 (as illustrated in FIG. 3). Rearward pillar 58 also receives a screw 64. Forward and rearward pillars 56 and 58 also are permeated with resin 32 or another resin and provide structural strength for securely receiving screws 64. Rearward pillar 58 is also oriented vertically and is positioned directly behind action recess 48.

FIG. 3 includes additional details showing the internal construction in the action and grip areas of stock 12. Specifically, the interface between hardware 14 and stock 12 is shown.

The hardware includes a magazine floor plate 60 secured beneath magazine recess 50. Recoil lug 62 projects downwardly from barrel 16 just in front of recoil crossbolt 44. A portion of action 20 (not shown) also extends just in from of action crossbolt 52. Thus, the recoil is effectively transferred to buttstock 24 of stock 12.

A reinforcement layer 66 is also provided over grip 26 of stock 12. This reinforcement layer 66 is provided in the grip area in the preferred embodiment to further strengthen this smaller portion of stock 12. Reinforcement layer 66 is preferably a fiberglass material. Reinforcement layer 66 is placed directly over foam core 40 beneath unidirectional fiberglass 38.

The preferred methods of construction of the above-described stock will now be discussed. The first step in construction of the preferred embodiment of stock 12 of the present invention is to provide a shaped foam core 40. Foam core 40 has the basic shape of stock 12, but includes a smaller section to allow room for the various layers to be applied thereon. Foam core 40 also includes apertures and recesses to allow resin 32 to form specific details, as well as, for fiberglass reinforcement structures such as crossbolts 44 and 52 and pillars 56 and 58. Foam core 40 is preferably formed from a single-piece rigid plastic foam. The foam is lightweight and sound absorbing.

After the step of providing foam core 40, the fiberglass crossbolts 44 and 52 are inserted into the core 40. Crossbolt arms 46 and 54 are then laid back along the sides of foam core 40 preferably to the rearward end of buttstock 24. Preferably, recoil crossbolt arms 46 are laid at least partially over action crossbolt arms 54, such that the two layers of fiberglass intermesh and become essentially one continuous piece of fiberglass material.

Reinforcement layer 66 is next placed over grip 26 and surrounding areas to provide reinforcement for this reduced section of stock 12. Reinforcement layer 66 is preferably comprised of a fiberglass cloth. Other weaker areas of the stock may also be covered with reinforcement layer 66, such as areas of action 20. Reinforcement layer 66 may be laid up with a resin at this time or may be permeated with resin 32 at a later point as described below in connection with laying up of the additional layers.

Next, unidirectional fiberglass 38 is wrapped around foam core 40. The unidirectional fiberglass 38 may be coated with an epoxy resin at this time or may simply be left dry until later steps of injection molding of an epoxy resin or thermoplastic resin as discussed below.

Camouflage layer 36 is next placed over unidirectional fiberglass 38. Camouflage layer 36 may be a fabric with a camouflage imprint or may be another decorative fabric or other decorative material. An article other than a gunstock may even be constructed with this method with any form of decorative material desired. Camouflage layer 36 is wrapped around stock 12 preferably from beneath, with the edges of camouflage layer 36 wrapping within the open top area of forearm 22. Hardware 14 will thus cover any uncamouflaged region within the top of stock 12. The bottom portions of camouflage layer 36 may be cut away to provide for action recess 48 and magazine recess 50.

Figure 4A:
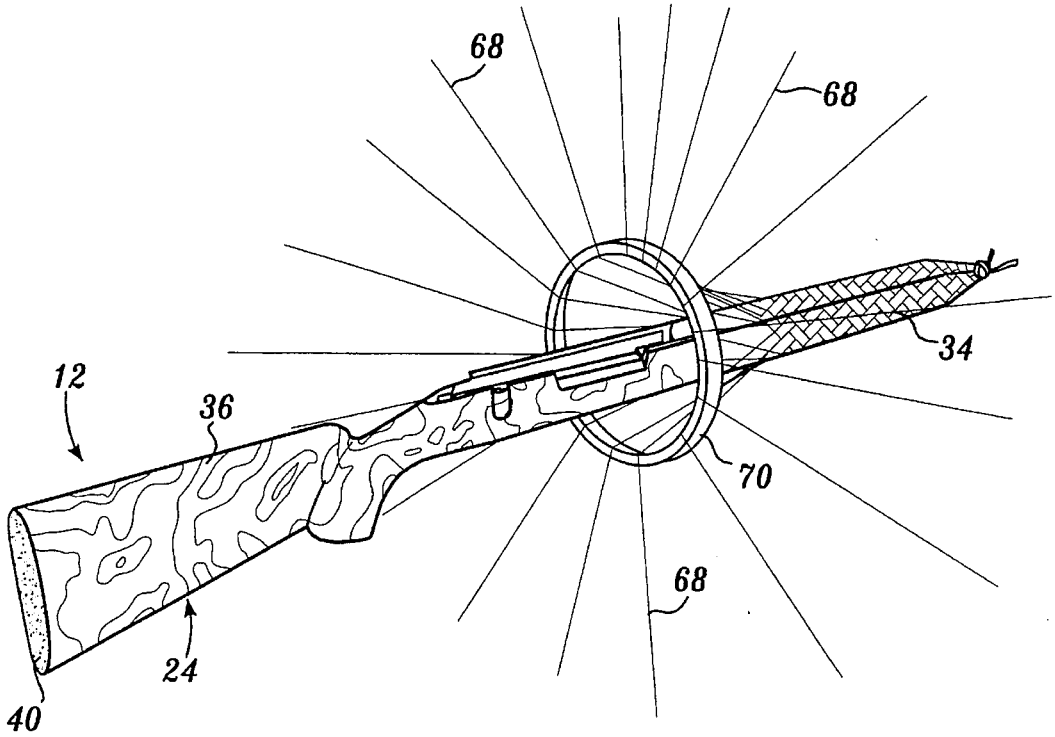
FIG. 4A is a perspective view of part of the construction of the preferred embodiment of the stock of the present invention.

The next step of the preferred method of constructing stock 12 involves braiding a fiberglass sock (braided fiberglass 34) around camouflage layer 36 of stock 12. This method step is illustrated in FIG. 4A. Preferably, a braider is used to braid glass strands 68 through a ring 70 provided with the braider onto stock 12. This method provides a seamless woven fiberglass sock around the entire stock 12 to form a one-piece shell that is especially durable and strong. Also, the shell is aesthetically pleasing since no seams exist.

Figure 4B:
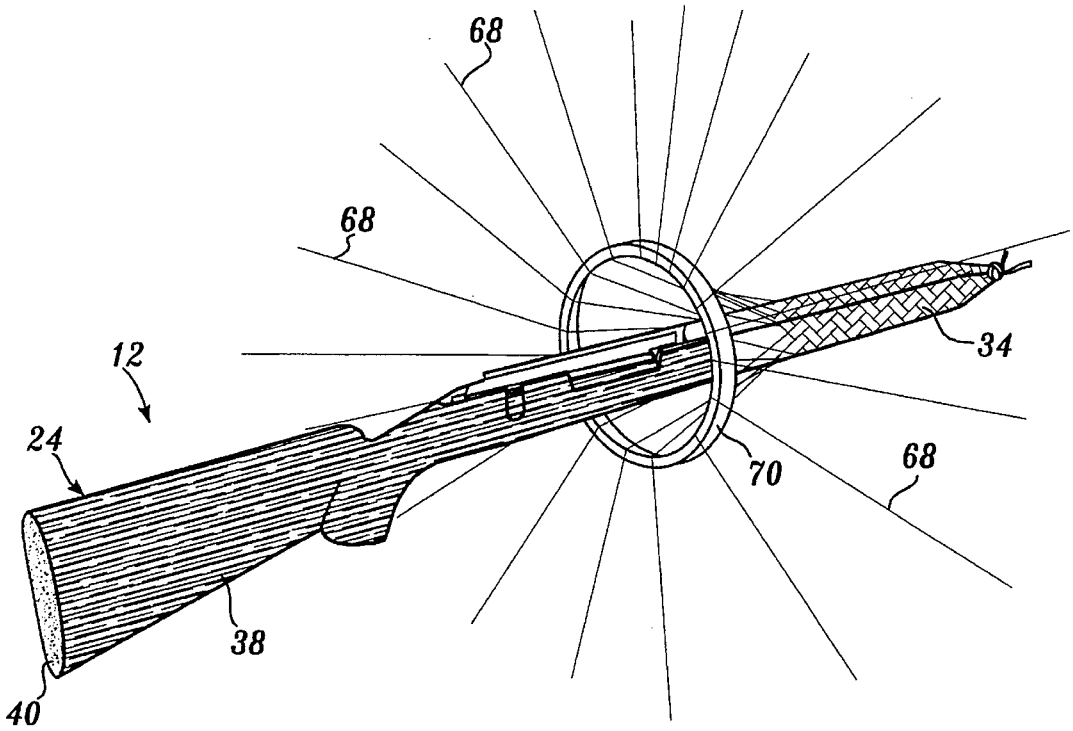
FIG. 4B is a perspective view of part of the construction of an alternative embodiment.
Figure 5:
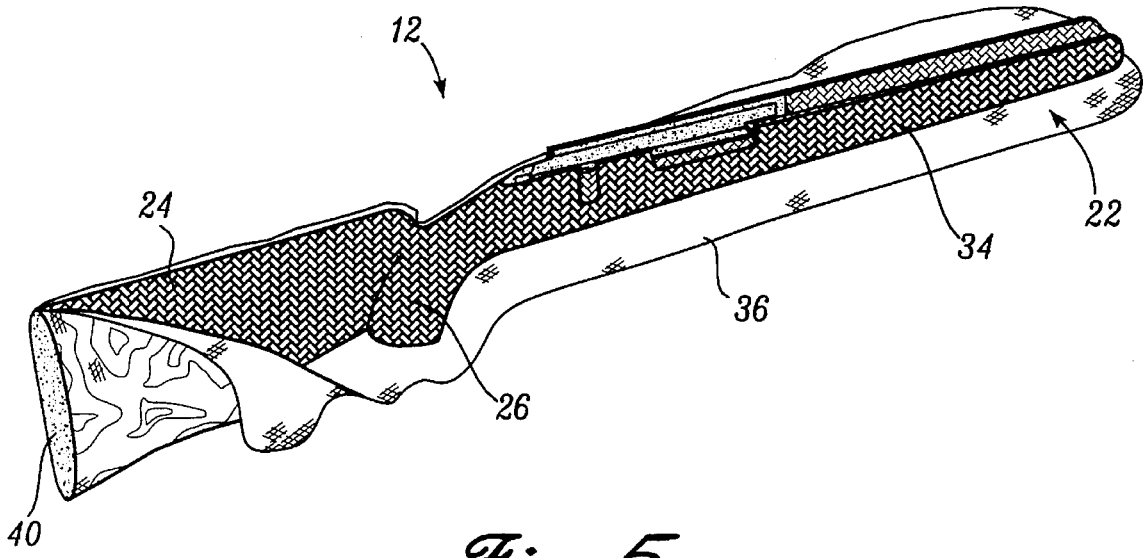
FIG. 5 is an illustration of a continuation of the construction of the alternate embodiment shown in FIG. 4B.

FIGS. 4B and 5 illustrate alternate steps of carrying out an alternate embodiment of the invention. With these steps the braided fiberglass 34 is braided onto stock 12 after the unidirectional fiberglass 38 is placed on stock 12. Camouflage layer 36 is not placed on stock 12 until after braided glass 34 (as shown in FIG. 5).

Figure 6:
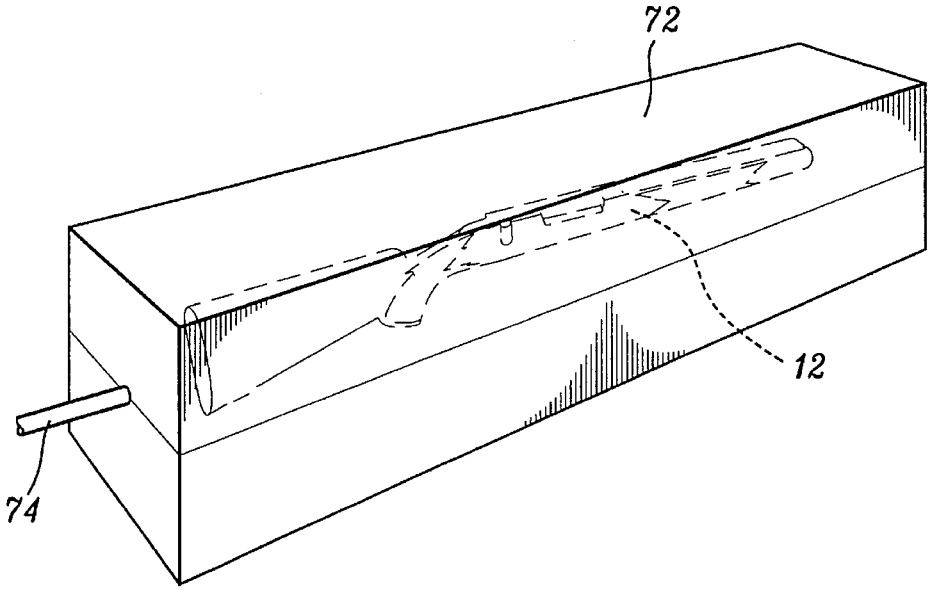
FIG. 6 illustrates the stock of the present invention in a mold.

In either embodiment, the stock with both the braided fiberglass 34 and camouflage layer 36 is then placed within a mold 72, as illustrated in FIG. 6. Mold 72 includes an inlet 74 into which preferably an epoxy resin is injected. Vacuum assist resin transfer molding is preferably carded out with the mold 72 including the fine detail and finished shape of stock 12. Thus, all the shape for interfacing with hardware 14, as well as the details, such as checkering 28, is provided in mold 72. Once cured and removed from mold 72, resin 32 forms the final outer clear coating of stock 12.

Stock 12 of the present invention, constructed in this manner, has the advantage of a camouflage stock that is well protected since the camouflage layer 36 cannot be marred or otherwise damaged without penetrating the outer layer of resin 32 in one embodiment or both the outer layer of resin and the braided fiberglass 34 in the preferred embodiment. As mentioned above, penetration of these layers will be difficult. Penetrating braided fiberglass 34 for example, would be very difficult without seriously damaging the structure of stock 12. Stock 12 is very lightweight since it is molded with resin transfer molding in a one piece, seamless, fiberglass shell. This lightweight, strong combination is reinforced with solid fiberglass crossbolts 44 and pillars 56 and 58 to effectively transfer the recoil. The fiberglass reinforcement thus flows continuously from one side, through the action area, and out the other side. Thus, integral crossbolts are provided, as opposed to crossbolts that are simply inserted. With the resin transfer molding process, the entire shell and internal support structures become a single integral piece that is stronger and lighter weight than otherwise would be attainable. Fine detail is provided with the vacuum assist resin transfer molding. For example, the checkering is preferably done with 24 lines per inch and may still be sharp and clean.

As mentioned above, articles other than gunstocks may also be constructed in similar manners with the steps described above. Alternatively, articles without cores can also be constructed with decorative layers being protected by fiberglass and resin layers. For example, a preferred method of decorating an article, such as a helmet, includes placing a first fiberglass layer in a mold; placing a decorative layer over at least a portion of the fiberglass; and impregnating the first fiberglass layer and the decorative layer with a resin. The first fiberglass layer and the resin become transparent and the decorative layer is seen through them while being well protected. This method may be further refined by adding a second fiberglass layer over the decorative layer on the opposite side of the decorative layer from the first fiberglass layer.

Figure 7:
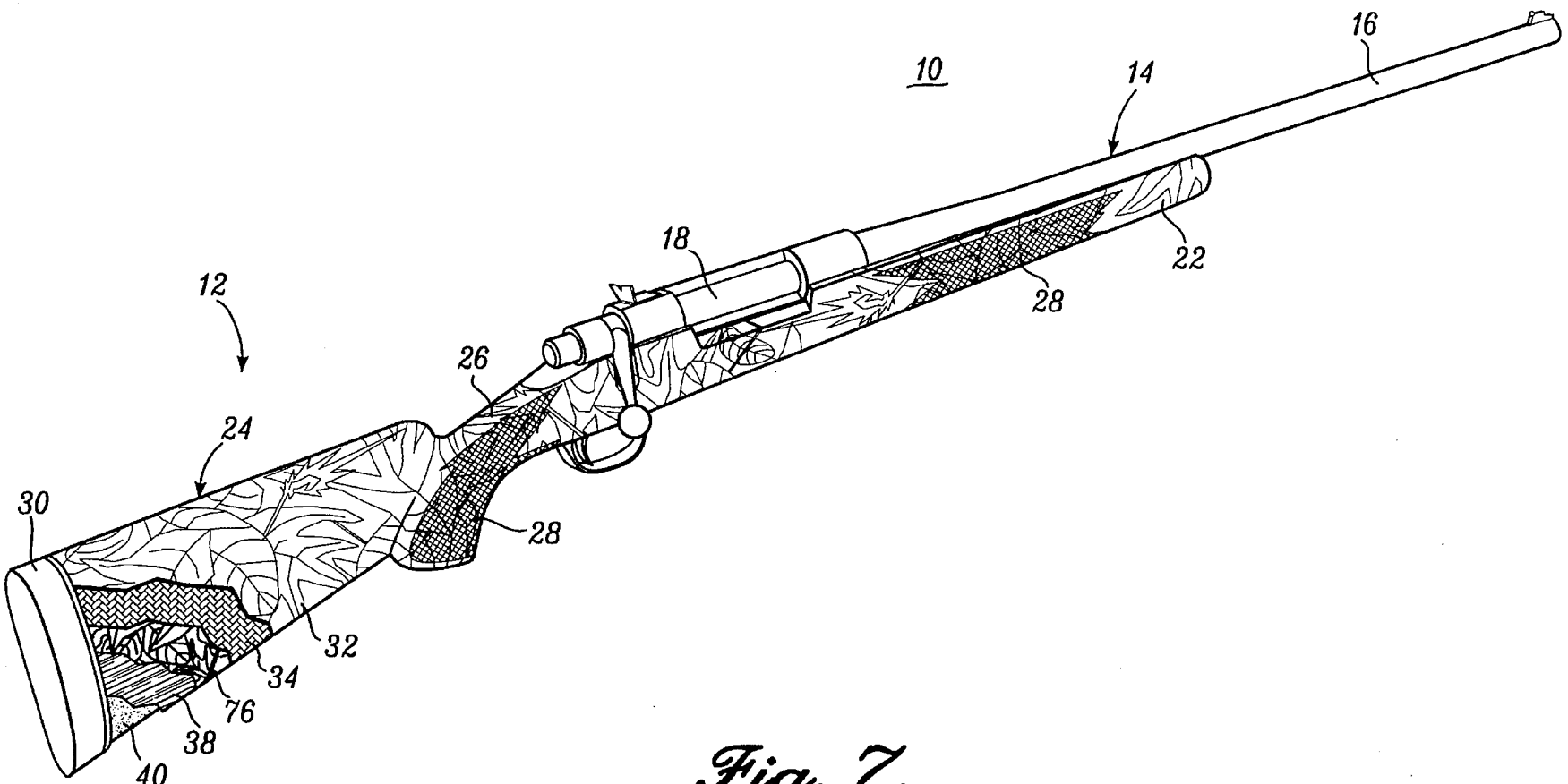
FIG. 7 is a perspective view of an alternate embodiment of the present invention showing the various layers.

Another alternate preferred embodiment of the invention is illustrated in FIG. 7. This embodiment is also made up of a foam core 40 covered with unidirectional fiberglass 38 and braided fiberglass 34 all permeated with resin 32. However, in this embodiment, natural foliage 76 is provided between braided fiberglass 34 and unidirectional fiberglass 38. After unidirectional fiberglass 38 is wrapped onto foam core 40, natural foliage 76 is glued or otherwise tacked into place over unidirectional fiberglass 38. Natural foliage 76 may be gathered from the area and season in which hunting with the gun will ultimately occur. Thus, since braided fiberglass 34 and resin 32 become transparent when cured, natural foliage 76 shows through to provide a very effective camouflage gunstock. Since natural foliage 76, since is completely encased within resin 32 from the vacuum assisted resin transfer molding process it does not deteriorate or degrade in form or color. Thus, the natural appearance is maintained indefinitely. In this embodiment, braided fiberglass 34 is braided directly over natural foliage 76 and holds it in place within mold 72 during the resin transfer molding process.

While the preferred embodiments of the present invention have been illustrated and described, it will be appreciated that various changes can be made therein without departing from the spirit and scope of the invention. For example, the basic method has been described in the context of creating and decorating a gunstock. However, other articles could be constructed and decorated with this basic method.

The embodiments of the invention in which an exclusive property or privilege is claimed are defined as follows:

1. An apparatus comprising:

(a) a core in the shape of a gunstock having a butt, grip, and a forearm;

(b) a composite crossbolt extending transversely through a portion of said core and having arms extending toward the butt of said stock adjacent the sides of said core; and (c) a resin impregnated fiber material disposed over said core and said crossbolt.

2. The apparatus of claim 1, further comprising a decorative layer arranged on said core between said resin impregnated fiber material and said core, and wherein said resin impregnated fiber material is substantially transparent such that said decorative layer is seen therethrough while being protected by said resin impregnated material.

3. The apparatus of claim 2, wherein said decorative layer comprises natural foliage.

4. The apparatus of claim 2, further comprising a second layer of fiber material disposed between said decorative layer and said core.

5. The apparatus of claim 4, wherein said arms of said crossbolt contact at least one of said first and second layers of fiber material.

6. The apparatus of claim 2, wherein said resin impregnated fiber material comprises a woven sock of fiberglass and said woven sock of fiberglass seamlessly encases said core and said decorative layer.

7. The gunstock of claim 1, further comprising a second composite crossbolt extending transversely through a portion of the forearm of said core rearwardly of said first composite crossbolt, said second composite crossbolt having arms extending toward the butt of the gunstock beneath said resin impregnated fiber material.

8. The gunstock of claim 1, further comprising a screw anchor pillar disposed within said core, said pillar comprising a fiber material impregnated and encapsulated in resin.

9. An apparatus comprising:

(a) a core in the shape of a gunstock;

(b) a first fiberglass layer comprising unidirectional fiberglass and disposed over said core;

(c) a second fiberglass layer disposed over said first fiberglass layer and said core, said second fiberglass layer comprising woven fiberglass; and (d) a resin permeating said first and second fiberglass layers, said resin also forming a protective layer over said layers.

10. The apparatus of claim 9, further comprising a decorative layer disposed between said first fiberglass layer and said core, said resin forming a transparent, protective layer over said decorative layer.

11. The gunstock of claim 10, wherein said decorative layer includes natural foliage.

12. The apparatus of claim 9, further comprising a decorative layer disposed between said first fiberglass layer and said second fiberglass layer, said resin forming a transparent, protective layer over said decorative layer.

13. The apparatus of claim 9, further comprising a decorative layer disposed over said second fiberglass layer, said resin forming a transparent, protective layer over said decorative layer.

14. The apparatus of claim 9, further comprising a composite crossbolt extending transversely through said core and having arms extending rearwardly adjacent the sides of the said core and underneath said first fiberglass layer.

15. The apparatus of claim 14, further comprising a second composite crossbolt extending transversely through a portion of the forearm of said core rearwardly of said first composite crossbolt, said second composite crossbolt having arms extending toward the butt of the gunstock beneath said first fiberglass layer.

16. The apparatus of claim 9, further comprising a screw anchor pillar disposed within said core, said pillar comprising a fiber material impregnated and encapsulated in resin.

17. A gunstock comprising:

(a) a core having a forearm, a grip, and a buttstock;

(b) a composite crossbolt extending transversely through a portion of the forearm of said core, said first composite crossbolt having arms extending toward the butt of the gunstock;

(c) a decorative layer substantially surrounding said core;

(d) a first fiber layer substantially surrounding said decorative layer; and (e) a resin impregnating said fiber layer, said resin and fiber layer being transparent such that said decorative layer is visible therethrough.

18. The gunstock of claim 17, wherein said decorative layer includes natural foliage.

19. The gunstock of claim 17, wherein said core is a one-piece rigid foam material.

20. The gunstock of claim 17, further comprising a screw anchor pillar disposed within said core, said pillar comprising a fiber material impregnated and encapsulated in resin.

21. The gunstock of claim 17, further comprising a second composite crossbolt extending transversely through a portion of the forearm of said core rearwardly of said first composite crossbolt, said second composite crossbolt having arms extending toward the butt of the gunstock beneath said first fiber layer.

22. The gunstock of claim 21, further comprising a second fiber layer disposed between said decorative layer and said core.

23. The gunstock of claim 17, further comprising a second fiber layer disposed between said decorative layer and said core.

24. The gunstock of claim 17, wherein said first fiber layer comprises a woven sock of fiberglass and said woven sock of fiberglass seamlessly encases said core and said decorative layer.

25. An apparatus comprising:

(a) a core in the shape of a gunstock and including a forearm, a grip, and a buttstock;

(b) a composite crossbolt extending transversely through a portion of said core and having arms extending adjacent the sides of said core;

(c) a first fiberglass layer disposed over said core;

(d) a decorative layer disposed over said fiberglass layer; and (e) a resin permeating said fiberglass layer, said crossbolt, and said decorative layer, said resin also forming a transparent, protective layer over said decorative layer.

26. The apparatus of claim 25, further comprising a second fiberglass layer between said first fiberglass layer and said core, wherein said first fiberglass layer comprises woven fiberglass and said second fiberglass layer comprises unidirectional fiberglass.

27. The apparatus of claim 25, wherein said first fiberglass layer is a woven sock of fiberglass seamlessly encasing said core beneath said decorative layer.

28. The gunstock of claim 25, further comprising a second composite crossbolt extending transversely through a portion of the forearm of said core rearwardly of said first composite crossbolt, said second composite crossbolt having arms extending toward the butt of the gunstock beneath said first fiber layer.

29. The gunstock of claim 28, further comprising a second fiberglass layer disposed between said first fiberglass layer and said core.

30. The apparatus of claim 25, wherein said decorative layer comprises natural foliage.

31. A gunstock comprising:

(a) a core having a forearm, a grip, and a buttstock;

(b) a composite crossbolt extending transversely through a portion of said core and having arms extending adjacent the sides of said core;

(c) an inner fiber layer disposed around said core;

(d) a decorative layer substantially surrounding said core and said inner fiber layer;

(e) an outer fiber layer substantially surrounding said decorative layer; and (f) a resin impregnating said outer fiber layer, said resin and said first fiber layer being transparent such that said decorative layer is visible therethrough.

32. The apparatus of claim 31, wherein said decorative layer comprises natural foliage.

33. The apparatus of claim 31, wherein said arms of said crossbolt contact at least one of said first and second layers of fiber material.

34. The gunstock of claim 31, further comprising a second composite crossbolt extending transversely through a portion of the forearm of said core rearwardly of said first composite crossbolt, said second composite crossbolt having arms extending toward the butt of the gunstock beneath said first fiber layer.

35. The gunstock of claim 31, further comprising a screw anchor pillar disposed within said core, said pillar comprising a fiber material impregnated and encapsulated in resin.

* * * * *